US011242872B2

(12) United States Patent
Wada

(10) Patent No.: US 11,242,872 B2
(45) Date of Patent: Feb. 8, 2022

(54) CYLINDER DEVICE

(71) Applicant: KOSMEK LTD., Kobe (JP)

(72) Inventor: Ryuichi Wada, Kobe (JP)

(73) Assignee: KOSMEK LTD., Kobe (JP)

( * ) Notice: Subject to any disclaimer, the term of this patent is extended or adjusted under 35 U.S.C. 154(b) by 0 days.

(21) Appl. No.: 17/267,822

(22) PCT Filed: Oct. 4, 2019

(86) PCT No.: PCT/JP2019/039228
§ 371 (c)(1),
(2) Date: Feb. 11, 2021

(87) PCT Pub. No.: WO2020/075629
PCT Pub. Date: Apr. 16, 2020

(65) Prior Publication Data

US 2021/0190098 A1 Jun. 24, 2021

(30) Foreign Application Priority Data

Oct. 12, 2018 (JP) ..... JP2018-193700

(51) Int. Cl.
*F15B 15/14* (2006.01)
*B25B 5/06* (2006.01)
*F15B 11/036* (2006.01)

(52) U.S. Cl.
CPC ..... *F15B 15/1423* (2013.01); *B25B 5/062* (2013.01); *F15B 11/0365* (2013.01); *F15B 15/1409* (2013.01)

(58) Field of Classification Search
CPC ..... F15B 15/1423; F15B 15/1409; F15B 15/1447; F15B 15/1457; F15B 15/149;
(Continued)

(56) References Cited

U.S. PATENT DOCUMENTS 2,983,256 A * 5/1961 Seeloff ..... F15B 15/1419 92/110
5,954,319 A * 9/1999 Yonezawa ..... B25B 5/062 269/24

(Continued)

FOREIGN PATENT DOCUMENTS

JP 2007-085492 A 4/2007
JP 2007-268625 A 10/2007
JP 2016-223473 A 12/2016

OTHER PUBLICATIONS

Search Report dated Dec. 10, 2019, issued in corresponding International application No. PCT/JP2019/039228.

*Primary Examiner* — Dustin T Nguyen
(74) *Attorney, Agent, or Firm* — Bacon & Thomas, PLLC

(57) ABSTRACT

A cylinder device includes: a first piston (8) inserted in a first cylinder hole (4) so as to be movable in an axial direction, a piston rod (7) being hermetically inserted in the first piston (8), the first piston (8) being fixed to the piston rod (7); a second piston (10, 37) inserted in a second cylinder hole (5) so as to be movable in the axial direction, the piston rod (7) being inserted in the second piston (10, 37); and a partition wall (13) dividing a cylinder hole (6) into the first cylinder hole (4) and the second cylinder hole (5), the partition wall (13) being movable in the axial direction.

9 Claims, 10 Drawing Sheets

(58) Field of Classification Search
CPC ..... F15B 15/26; F15B 2015/268; F15B 11/0365; B25B 5/062; B25B 5/064; B25B 5/122; B25B 5/087
See application file for complete search history.

(56) References Cited

U.S. PATENT DOCUMENTS

| | | | | |
|---|---|---|---|---|
| 6,427,992 | B1 * | 8/2002 | Noda | B25B 5/062 269/24 |
| 6,633,015 | B2 * | 10/2003 | Nguyen | B23K 11/31 219/89 |
| 9,476,435 | B2 * | 10/2016 | Yamaguchi | B60T 13/586 |
| 9,951,799 | B2 * | 4/2018 | Kawakami | B25B 5/062 |
| 2012/0292843 | A1 * | 11/2012 | Yokota | B25B 5/062 269/20 |

* cited by examiner

CYLINDER DEVICE

TECHNICAL FIELD

The present invention relates to a tandem cylinder device.

BACKGROUND ART

Known examples of such a cylinder device include a device described in Patent Literature 1 specified below. The known device is structured as follows.

The device described in Patent Literature 1, which is a pull clamping device, includes a partition wall separating first and second cylinder holes from each other, and the partition wall is restrained to prevent its up/down movement (see paragraph 0033 of Patent Literature 1). The pull clamping device further includes a piston rod rotating mechanism.

CITATION LIST

Patent Literature

Patent Literature 1: Japanese Unexamined Patent Publication No. 2016-223473

SUMMARY OF INVENTION

Technical Problem

The above-described known device has the following disadvantage.

In the known device, the partition wall is restrained to prevent its up/down movement. Due to this, not only in the process of clamping to switch the device from an unclamping state to a clamping state, but also in the process of unclamping to switch the device from the clamping state to the unclamping state, the force of pressure fluid is strongly exerted to a first piston portion and to a second piston portion, with the result that a piston rod is moved to an unclamping side by the strong force. Because of this, the piston rod moves fast also in the unclamping process, and this makes it more likely to advance the progress of abrasion at portions of elements such as the piston rod rotating mechanism, which are engaged with and/or configured to slide on the piston rod.

An object of the present invention is to provide a tandem cylinder device capable of relieving progress of abrasion at portions engaged with and/or configured to slide on a piston rod.

Solution to Problem

In order to achieve the above object, in the present invention, a cylinder device is structured as follows, as shown in FIG. 1 to FIG. 10, for example.

A cylinder device of an aspect of the present invention includes: a housing 1; a cylinder hole 6 provided in the housing 1, the cylinder hole 6 having a first cylinder hole 4 and a second cylinder hole 5 provided on a leading end side relative to the first cylinder hole 4; a piston rod 7 inserted in the cylinder hole 6 so as to be movable in an axial direction; a first piston 8 inserted in the first cylinder hole 4 so as to be movable in the axial direction, the piston rod 7 being hermetically inserted in the first piston 8, the first piston 8 being fixed to the piston rod 7; a second piston 10, 37 inserted in the second cylinder hole 5 so as to be movable in the axial direction, the piston rod 7 being inserted in the second piston 10, 37; a partition wall 13 dividing the cylinder hole 6 into the first cylinder hole 4 and the second cylinder hole 5, the partition wall 13 being movable in the axial direction; a first lock chamber 16 provided between the first piston 8 and the partition wall 13; a second lock chamber 17 provided on the leading end side relative to the second piston 10, 37; a first release chamber 23 provided on a base end side relative to the first piston 8 and to the piston rod 7; a second release chamber 24 provided between the partition wall 13 and the second piston 10, 37; a locking-purpose passage 21 through which pressure fluid is supplied to and discharged from the first lock chamber 16 and the second lock chamber 17; and a releasing-purpose passage 25, 34 through which pressure fluid is supplied to and discharged from the first release chamber 23 and the second release chamber 24.

The cylinder device of the above aspect of the present invention provides the following functions and effects.

As pressure fluid is supplied to the second release chamber, the partition wall moves temporarily toward the base end side. Because of this, forces of the pressure fluid in the second release chamber are canceled out with respect to the axial direction, and do not act to drive the piston rod. For this reason, the piston rod is moved toward the leading end side only by the force of pressure fluid in the first release chamber. As a result, the piston rod moves relatively slowly toward the leading end side, thereby to relieve progress of abrasion at portions engaged with and/or configured to slide on the piston rod.

In the cylinder device of the above aspect of the present invention, it is preferable that the piston rod 7 is hermetically inserted in the second piston 10, and the second piston 10 is fixed to the second piston 10.

Furthermore, in the cylinder device of the above aspect of the present invention, it is preferable that: the locking-purpose passage 21 includes a locking-purpose communication passage 20, 31 which communicatively connects the first lock chamber 16 and the second lock chamber 17 to each other; and the locking-purpose communication passage 20, 31 is provided in the piston rod 7.

Furthermore, in the cylinder device of the above aspect of the present invention, it is preferable that the locking-purpose communication passage 31 includes: a first locking-purpose communication passage 32 provided in the piston rod 7 so as to extend from the first lock chamber 16; and a second locking-purpose communication passage 33 provided in the piston rod 7 so as to extend from the second lock chamber 17, and that at least one of the first locking-purpose communication passage 32 and the second locking-purpose communication passage 33 extends obliquely relative to the axial direction of the piston rod 7, and the first locking-purpose communication passage 32 and the second locking-purpose communication passage 33 are connected to each other.

This arrangement makes it easy to provide the locking-purpose communication passage in the piston rod.

Furthermore, in the cylinder device of the above aspect of the present invention, it is preferable that: the releasing-purpose passage 34 includes a releasing-purpose communication passage 35 which communicatively connects the first release chamber 23 and the second release chamber 24 to each other; and the releasing-purpose communication passage 35 is provided in the piston rod 7.

Furthermore, in the cylinder device of the above aspect of the present invention, it is preferable that the second piston 37 includes: an annular second piston main body 38; and a tubular guide portion 39 extending in the axial direction from the second piston main body 38, the guide portion 39 being hermetically inserted in the partition wall 13, that the locking-purpose passage includes a locking-purpose communication passage 41, 44 which communicatively connects the first lock chamber 16 and the second lock chamber 17 to each other, and that the locking-purpose communication passage 41, 44 is provided between a tubular hole 37*a* of the second piston 37 and an outer peripheral surface of the piston rod 7.

This arrangement makes it possible to provide the locking-purpose passage without boring a hole in the piston rod. That is, machining on the piston rod is easy.

Furthermore, in the cylinder device of the above aspect of the present invention, it is preferable that the locking-purpose communication passage 41 is a groove 41 provided on a surface of the piston rod 7 and extending in the axial direction.

Providing a groove on the surface of the piston rod is easier than boring a hole in the piston rod, in terms of machining on the piston rod.

Furthermore, in the cylinder device of the above aspect of the present invention, it is preferable that the locking-purpose communication passage 44 is an annular gap 44 between the tubular hole 37*a* of the second piston 37 and the outer peripheral surface of the piston rod 7.

The gap can be created by designing the outer diameter of the piston rod to be slightly smaller than the diameter of the tubular hole of the second piston, and therefore machining on the piston rod is easy.

Furthermore, in the cylinder device of the above aspect of the present invention, it is preferable that the piston rod 7 is inserted in the second piston 37, and the second piston 37 is fixed to the piston rod 7.

Furthermore, in the cylinder device of the above aspect of the present invention, it is preferable that the piston rod 7 is inserted in the second piston 37, and the second piston 37 is configured to be engaged with the partition wall 13.

Furthermore, in the cylinder device of the above aspect of the present invention, it is preferable that a piston rod rotating mechanism 26 is provided on the base end side relative to the first piston 8.

This arrangement allows the piston rod to rotate.

Advantageous Effects of Invention

According to embodiments of the present invention, it is possible to provide a tandem cylinder device capable of relieving progress of abrasion at portions engaged with and/or configured to slide on a piston rod.

DESCRIPTION OF EMBODIMENTS

Figure 1:
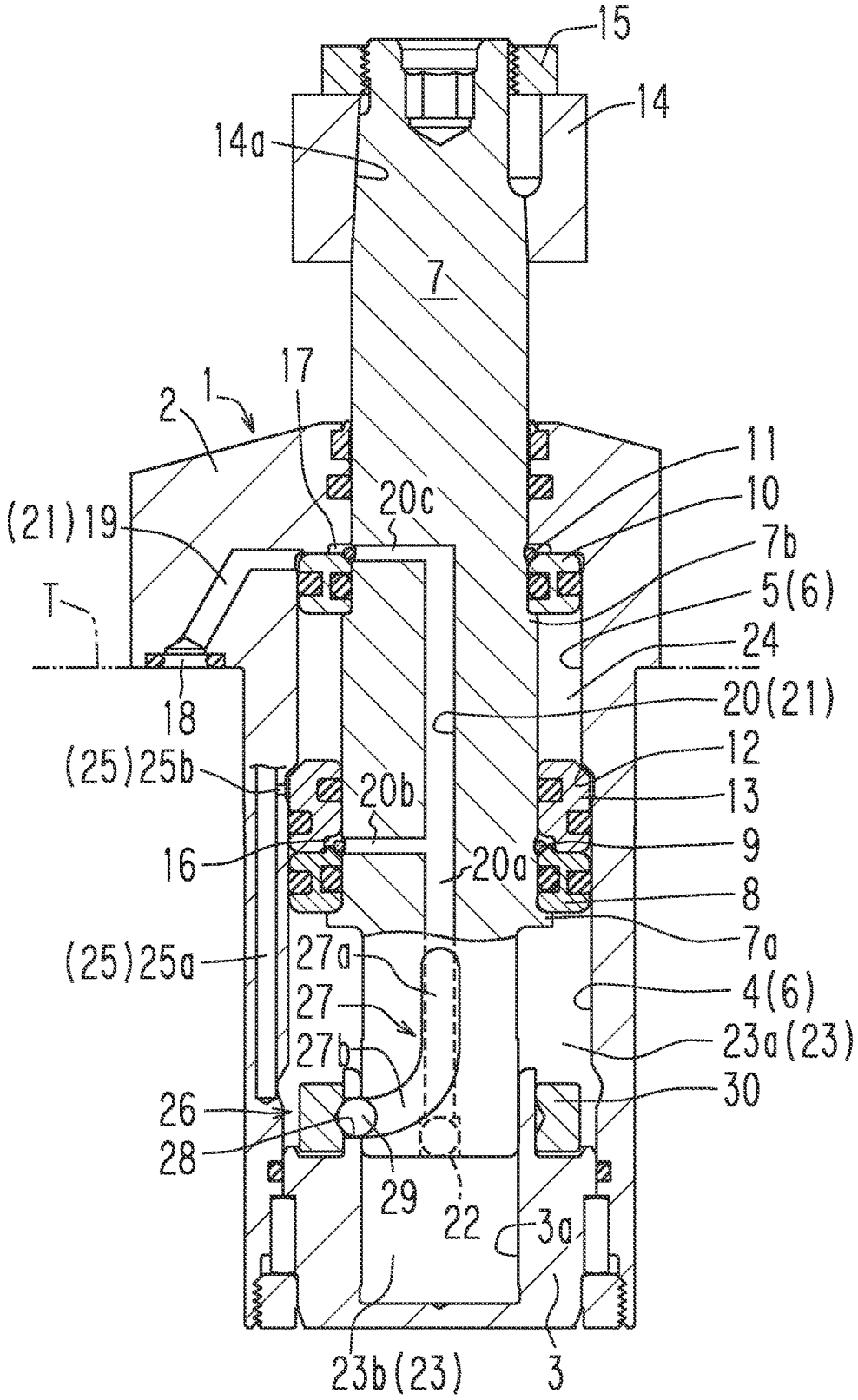
FIG. 1 shows a first embodiment of the present invention, and is an elevational view in section of a cylinder device in a release state.
Figure 2:
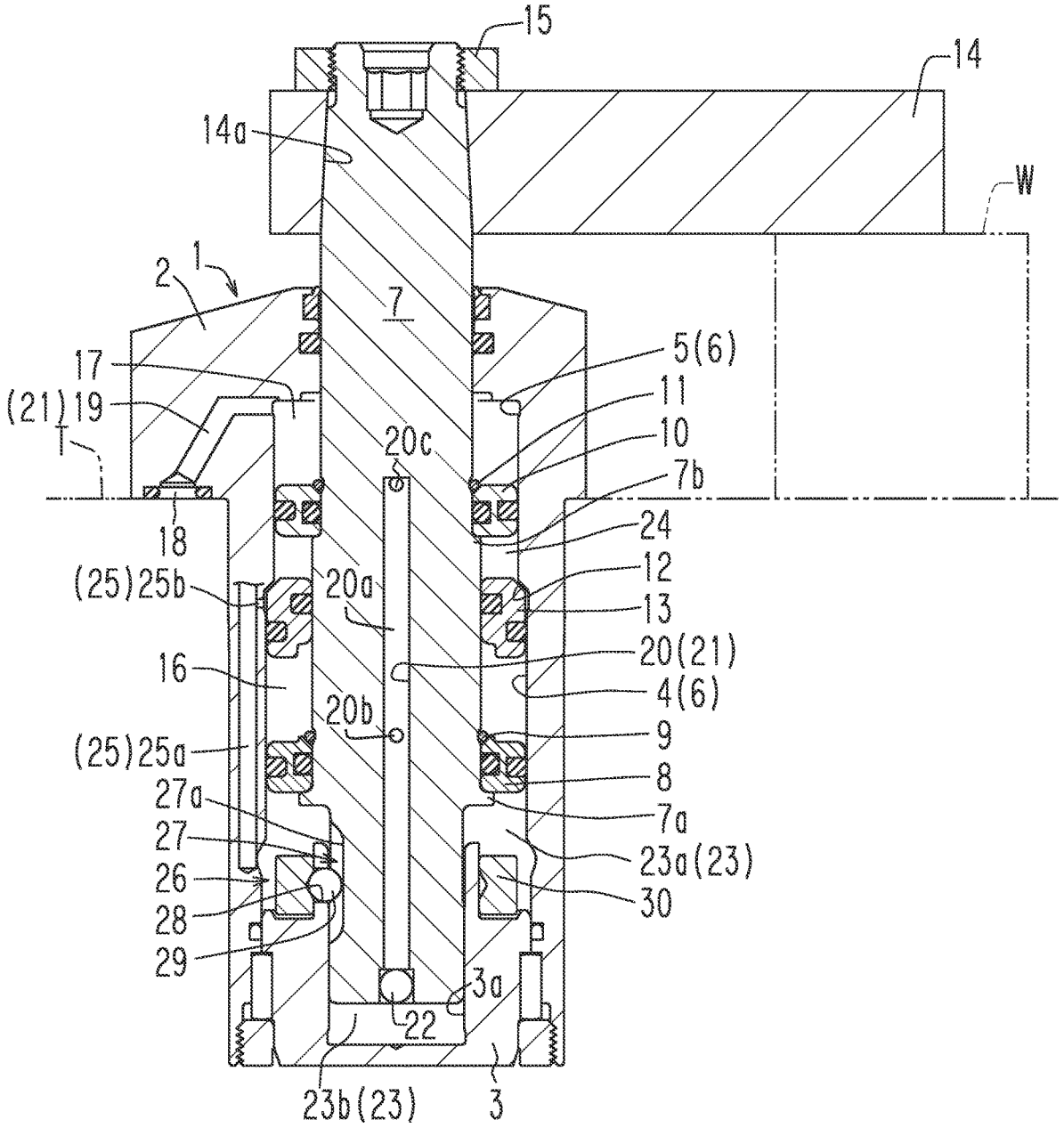
FIG. 2 is an elevational view in section of the cylinder device in a lock state.
Figure 3:
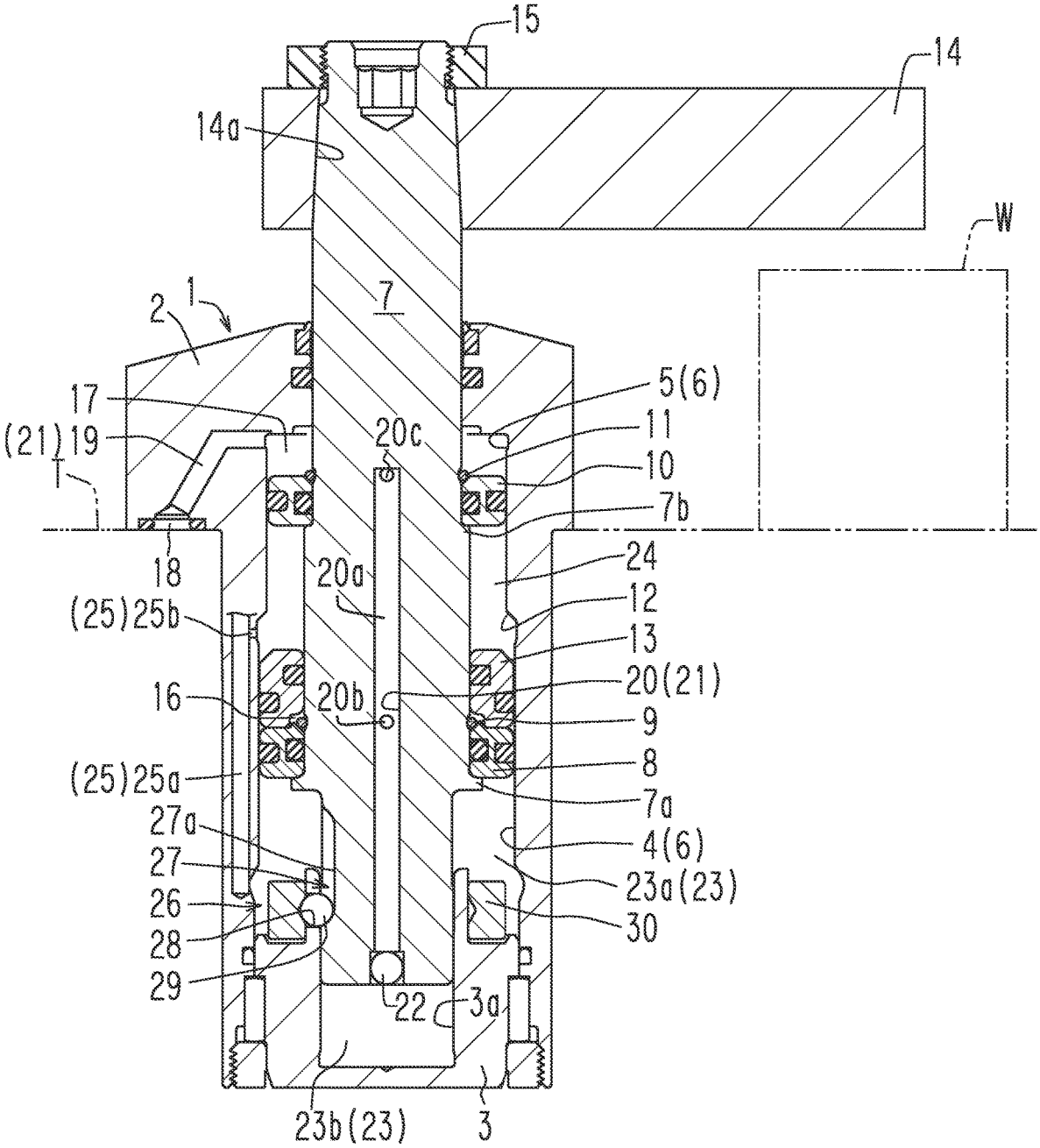
FIG. 3 is an elevational view in section of the cylinder device which is in the course of transition from the lock state to the release state.

FIG. 1 to FIG. 3 show a first embodiment of the present invention.

This embodiment deals with a case where a cylinder device of the present invention is applied to a rotary clamp, by way of example. The structure of the cylinder device of the first embodiment of the present invention will be described with reference to FIG. 1 to FIG. 3.

A housing 1 is attached to a stationary stand T such as a table. The housing 1 includes: a housing main body 2; and a lower end wall 3 of a tubular shape with a bottom, which is fixed to a lower end portion of the housing main body 2. A first cylinder hole 4 is provided in a lower portion of the housing main body 2. A second cylinder hole 5 is provided above (on a leading end side relative to) the first cylinder hole 4. The first cylinder hole 4 and the second cylinder hole 5 constitute a cylinder hole 6.

A piston rod 7 is inserted in the cylinder hole 6 so as to be movable in an up-down direction (in an axial direction). A leading-end-side portion of the piston rod 7 is shaped to taper down toward its end. The tapered portion is fitted in a hole 14*a* provided at an end portion of a clamp arm 14 and is fixed with a nut 15. A lower end portion of the piston rod 7 is inserted in a support hole 3*a* provided in the lower end wall 3 of the housing 1.

A first piston 8 is hermetically inserted in the first cylinder hole 4, which is a lower portion of the cylinder hole 6, so as to be movable in the up-down direction (axial direction). The piston rod 7 is hermetically inserted in the first piston 8. The first piston 8 is fixed to the piston rod 7 with a flange portion 7*a* provided on an outer periphery of a lower portion of the piston rod 7 and with a retaining ring 9.

A second piston 10 is hermetically inserted, above the first piston 8, in the second cylinder hole 5 so as to be movable in the up-down direction (axial direction). The piston rod 7 is hermetically inserted in the second piston 10. The second piston 10 is fixed to the piston rod 7 with a step portion 7*b* on an outer periphery of the piston rod 7, which is provided above the flange portion 7*a*, and with a retaining ring 11.

The first cylinder hole 4 has a diameter larger than that of the second cylinder hole 5. A portion between the first cylinder hole 4 and the second cylinder hole 5 is a step portion 12 of a tapered shape, for example. A partition wall 13 dividing the cylinder hole 6 into the first cylinder hole 4 and the second cylinder hole 5 is hermetically inserted in the step portion 12. The partition wall 13 is not fixed to the housing main body 2, and is movable in the first cylinder hole 4 in the axial direction. However, due to the thus configured step portion 12, the partition wall 13 is prevented from moving upward over (toward the leading end side relative to) the step portion 12.

A first lock chamber 16 for moving the first piston 8 downward (toward the base end side) is provided between the first piston 8 and the partition wall 13. A second lock chamber 17 for moving the second piston 10 downward (toward the base end side) is provided above (on the leading end side relative to) the second piston 10. Pressurized oil functioning as pressure fluid for locking is supplied to and discharged from the first lock chamber 16 and the second lock chamber 17 via a common lock port 18. The lock port 18 is connected to the second lock chamber 17 by a port-side passage 19 provided in the housing main body 2. The second lock chamber 17 and the first lock chamber 16 are communicatively connected to each other by a locking-purpose communication passage 20 provided in the piston rod 7. The port-side passage 19 and the locking-purpose communication passage 20 constitute a locking-purpose passage 21 through which pressure fluid is supplied to and discharged from the first lock chamber 16 and the second lock chamber 17. The locking-purpose communication passage 20 includes: a hole 20*a* bored from a base end surface of the piston rod 7 toward the leading end side and extending in the axial direction; and two holes 20*b* and 20*c* each bored radially inward from an outer peripheral surface of the piston rod 7. An opening of the hole 20*a* is closed by a plug ball 22. A supply and discharge passage of pressurized oil to the lock port 18 is not illustrated.

A first release chamber 23 is provided below (on the base end side relative to) the first piston 8 and below (on the base end side relative to) the piston rod 7. A second release chamber 24 is provided between the partition wall 13 and the second piston 10. The first release chamber 23 includes: a leading-end-side release chamber 23*a* provided between the first piston 8 and the lower end wall 3; and a base-end-side release chamber 23*b* provided in the support hole 3*a*. The leading-end-side release chamber 23*a* and the base-end-side release chamber 23*b* communicate with each other.

Pressurized oil functioning as pressure fluid for releasing is supplied to and discharged from the first release chamber 23 and the second release chamber 24 via a releasing-purpose passage 25. The releasing-purpose passage 25 includes a main release passage 25*a* and a branching release passage 25*b*, which are provided in the housing main body 2. A release port communicatively connected to the releasing-purpose passage 25 is not illustrated.

A piston rod rotating mechanism 26 is provided on the base end side relative to the first piston 8. In other words, it is provided at the lower end portion of the piston rod 7. The piston rod rotating mechanism 26 is structured as follows.

At least one guide groove 27 including a straight linear groove 27*a* and a spiral rotation groove 27*b* which are provided continuously in the up-down direction is provided on an outer peripheral surface of the lower end portion of the piston rod 7. At least one lateral hole 28 is provided at an upper portion of a peripheral wall of the support hole 3*a*. A ball 29 inserted in the lateral hole 28 is fitted in the guide groove 27. A sleeve 30 is rotatably fitted over the outer periphery of the ball 29.

The cylinder device having the above-described structure operates as follows.

In the release state shown in FIG. 1, pressurized oil has been discharged from the first lock chamber 16 and from the second lock chamber 17, and pressurized oil has been supplied to the first release chamber 23 and to the second release chamber 24.

To cause the device to transition from the release state shown in FIG. 1 to the lock state shown in FIG. 2, pressurized oil in the first release chamber 23 and in the second release chamber 24 is discharged to the outside through the releasing-purpose passage 25, and pressurized oil is supplied from the lock port 18 to the second lock chamber 17 through the port-side passage 19. The pressurized oil supplied to the second lock chamber 17 is also supplied to the first lock chamber 16 via the locking-purpose communication passage 20. As a result, the pressurized oil in the second lock chamber 17 causes the second piston 10 to push the piston rod 7 downward, while the pressurized oil in the first lock chamber 16 causes the first piston 8 to push the piston rod 7 downward. Because of this, the piston rod 7 descends while rotating in a clockwise direction due to the function of the piston rod rotating mechanism 26, and then the piston rod 7 descends straight. The descent of the piston rod 7 causes a leading end portion of the clamp arm 14 to press a to-be-clamped object W from above, as shown in FIG. 2. With this, the descent of the piston rod 7 is stopped and the device is put into the lock state.

To cause the device to transition from the lock state shown in FIG. 2 to the release state shown in FIG. 1, pressurized oil in the first lock chamber 16 and in the second lock chamber 17 is discharged to the outside through the port-side passage 19, and pressurized oil is supplied to the first release chamber 23 and to the second release chamber 24 through the releasing-purpose passage 25. Then, the partition wall 13 is temporarily lowered by the pressurized oil in the second release chamber 24, as shown in FIG. 3. Because of this, forces of the pressurized oil in the second release chamber 24 are canceled out with respect to the axial direction, and do not act to drive the piston rod 7. For this reason, the piston rod 7 is raised only by the force of the pressurized oil in the first release chamber 23. After hitting on the first piston 8 ascending from below, the partition wall 13 ascends with the first piston 8. The piston rod 7 ascends straight first and then ascends while rotating in a counterclockwise direction due to the function of the piston rod rotating mechanism 26. The ascent of the piston rod 7 causes the second piston 10 to come into contact with a ceiling surface in the housing main body 2, as shown in FIG. 1. With this, the ascent of the piston rod 7 is stopped, and the device is put into the release state.

Figure 4:
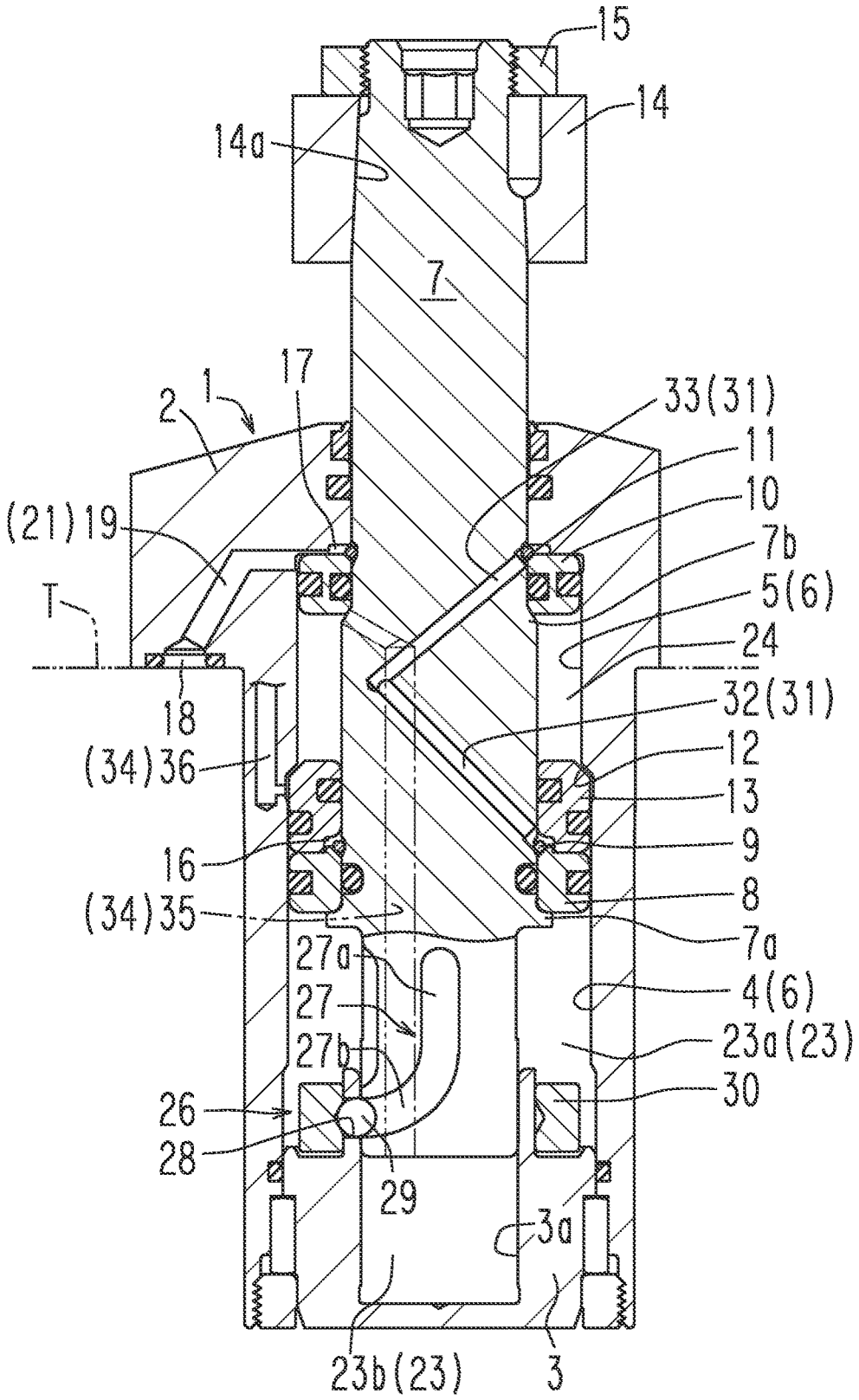
FIG. 4 shows a second embodiment of the present invention, and is an elevational view in section of a cylinder device in the release state.
Figure 5:
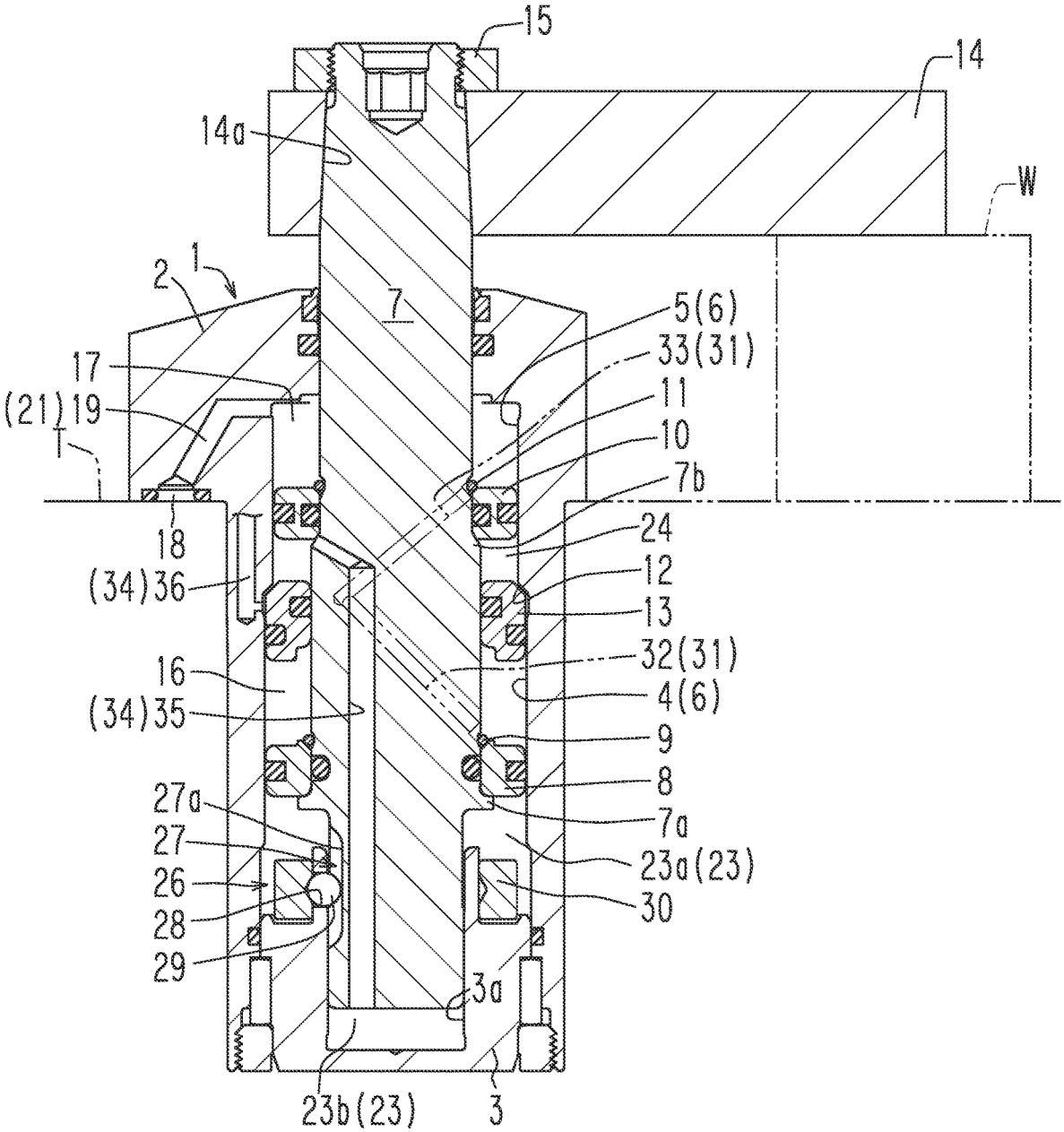
FIG. 5 is an elevational view in section of the cylinder device shown in FIG. 4, which is in the lock state.

FIG. 4 to FIG. 5 show a second embodiment of the present invention. The following describes differences between a cylinder device of the second embodiment and the cylinder device of the first embodiment shown in FIG. 1 to FIG. 3.

A locking-purpose communication passage 31 of the cylinder device of the second embodiment includes: a first locking-purpose communication passage 32 extending obliquely upward from the first lock chamber 16 toward the inside of the piston rod 7; and a second locking-purpose communication passage 33 extending obliquely downward from the second lock chamber 17 toward the inside of the piston rod 7. The first locking-purpose communication passage 32 and the second locking-purpose communication passage 33 are connected to each other. The locking-purpose communication passage 20 of the cylinder device of the first embodiment shown in FIG. 1 to FIG. 3 needs the plug ball 22 to close the opening of the hole 20*a*; however, a sealing member such as the plug ball 22 is not needed for the locking-purpose communication passage 31 in the second embodiment.

A releasing-purpose passage 34 of the cylinder device of the second embodiment includes a releasing-purpose communication passage 35 which communicatively connects the base-end-side release chamber 23*b* of the first release chamber 23 and the second release chamber 24 to each other. Pressurized oil is supplied to and discharged from the second release chamber 24 through a release passage 36 provided in the housing main body 2. The releasing-purpose communication passage 35 is provided in the piston rod 7. Pressurized oil is supplied to and discharged from the first release chamber 23 via the second release chamber 24 through the releasing-purpose communication passage 35.

The operation of the cylinder device at the time of transition from the release state shown in FIG. 4 to the lock state shown in FIG. 5 is similar to that in the first embodiment. As pressurized oil is supplied from the lock port 18 to the second lock chamber 17 via the port-side passage 19, pressurized oil supplied to the second lock chamber 17 is also supplied to the first lock chamber 16 via the locking-purpose communication passage 31. As a result, the pressurized oil in the second lock chamber 17 causes the second piston 10 to push the piston rod 7 downward, while the pressurized oil in the first lock chamber 16 causes the first piston 8 to push the piston rod 7 downward. This causes the piston rod 7 to descend.

The operation of the cylinder device at the time of transition from the lock state shown in FIG. 5 to the release state shown in FIG. 4 is also similar to that in the first embodiment. As pressurized oil is supplied to the second release chamber 24 through the release passage 36, the partition wall 13 is temporarily lowered by the pressurized oil in the second release chamber 24. Because of this, forces of the pressurized oil in the second release chamber 24 are canceled out with respect to the axial direction, and do not act to drive the piston rod 7. For this reason, the piston rod 7 is raised only by the force of the pressurized oil in the first release chamber 23.

Figure 6:
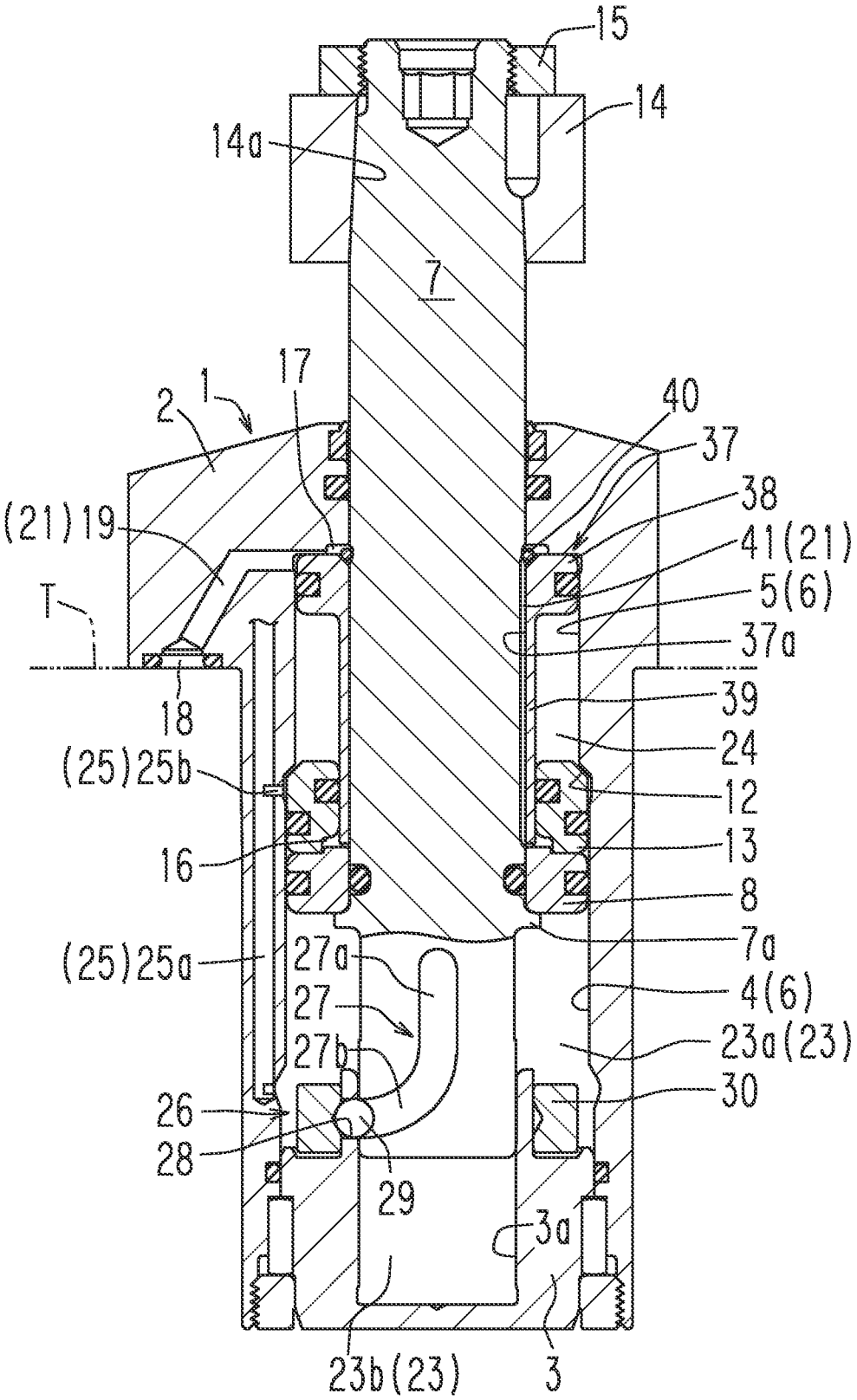
FIG. 6 shows a third embodiment of the present invention, and is an elevational view in section of a cylinder device in the release state.
Figure 7:
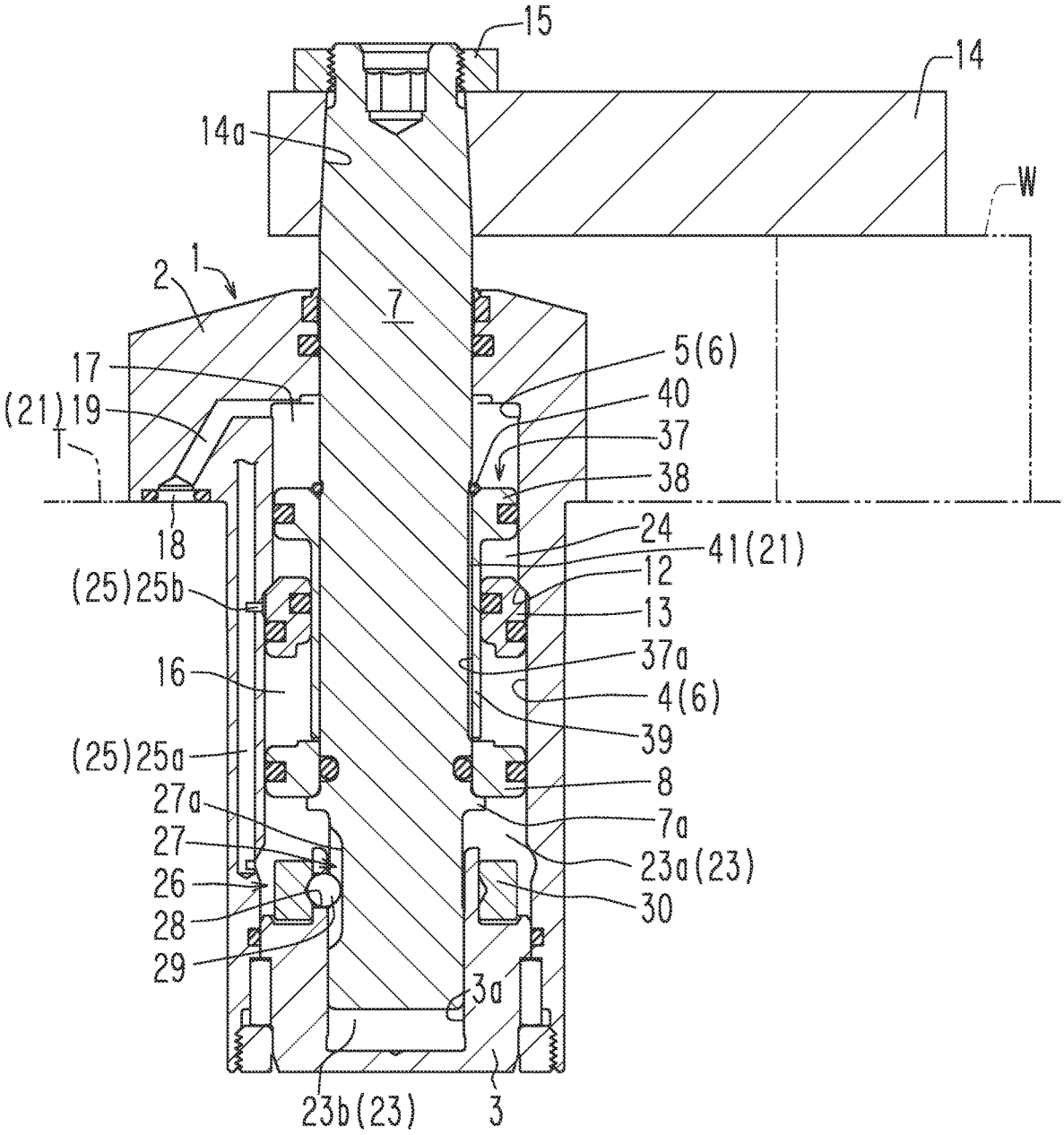
FIG. 7 is an elevational view in section of the cylinder device shown in FIG. 6, which is in the lock state.

FIG. 6 and FIG. 7 show a third embodiment of the present invention. The following describes differences between a cylinder device of the third embodiment and the cylinder device of the first embodiment shown in FIG. 1 to FIG. 3.

A second piston 37 of the cylinder device of the third embodiment includes: an annular second piston main body 38; and a tubular guide portion 39 extending from the second piston main body 38 downward (toward the base end side). The piston rod 7 is inserted in the second piston 37, and the guide portion 39 of the second piston 37 is hermetically inserted in the partition wall 13. The second piston 37 and the first piston 8 are fixed to the piston rod 7 with the flange portion 7*a* provided on the outer periphery of the lower portion of the piston rod 7, and with a retaining ring 40, respectively.

The cylinder device of the third embodiment includes a groove 41 which communicatively connects the first lock chamber 16 and the second lock chamber 17 to each other and extends in the axial direction. The groove 41 is provided on a surface of the piston rod 7. The groove 41 functions as a locking-purpose communication passage provided between a tubular hole 37*a* of the second piston 37 and the outer peripheral surface of the piston rod 7. The locking-purpose passage 21 of the cylinder device of the third embodiment is constituted by the port-side passage 19 and the groove 41 functioning as the locking-purpose communication passage.

The operation of the cylinder device at the time of transition from the release state shown in FIG. 6 to the lock state shown in FIG. 7 is similar to that in the first embodiment. As pressurized oil is supplied from the lock port 18 to the second lock chamber 17 via the port-side passage 19, pressurized oil supplied to the second lock chamber 17 is also supplied to the first lock chamber 16 via the groove 41. As a result, the pressurized oil in the second lock chamber 17 causes the second piston 37 to push the piston rod 7 downward via the first piston 8, while the pressurized oil in the first lock chamber 16 causes the first piston 8 to push the piston rod 7 downward. This causes the piston rod 7 to descend.

The operation of the cylinder device at the time of transition from the lock state shown in FIG. 7 to the release state shown in FIG. 6 is also similar to that in the first embodiment. As pressurized oil is supplied to the first release chamber 23 and to the second release chamber 24 through the releasing-purpose passage 25, the partition wall 13 is temporarily lowered by the pressurized oil in the second release chamber 24. Because of this, forces of the pressurized oil in the second release chamber 24 are canceled out with respect to the axial direction, and do not act to drive the piston rod 7. For this reason, the piston rod 7 is raised only by the force of the pressurized oil in the first release chamber 23.

Figure 8:
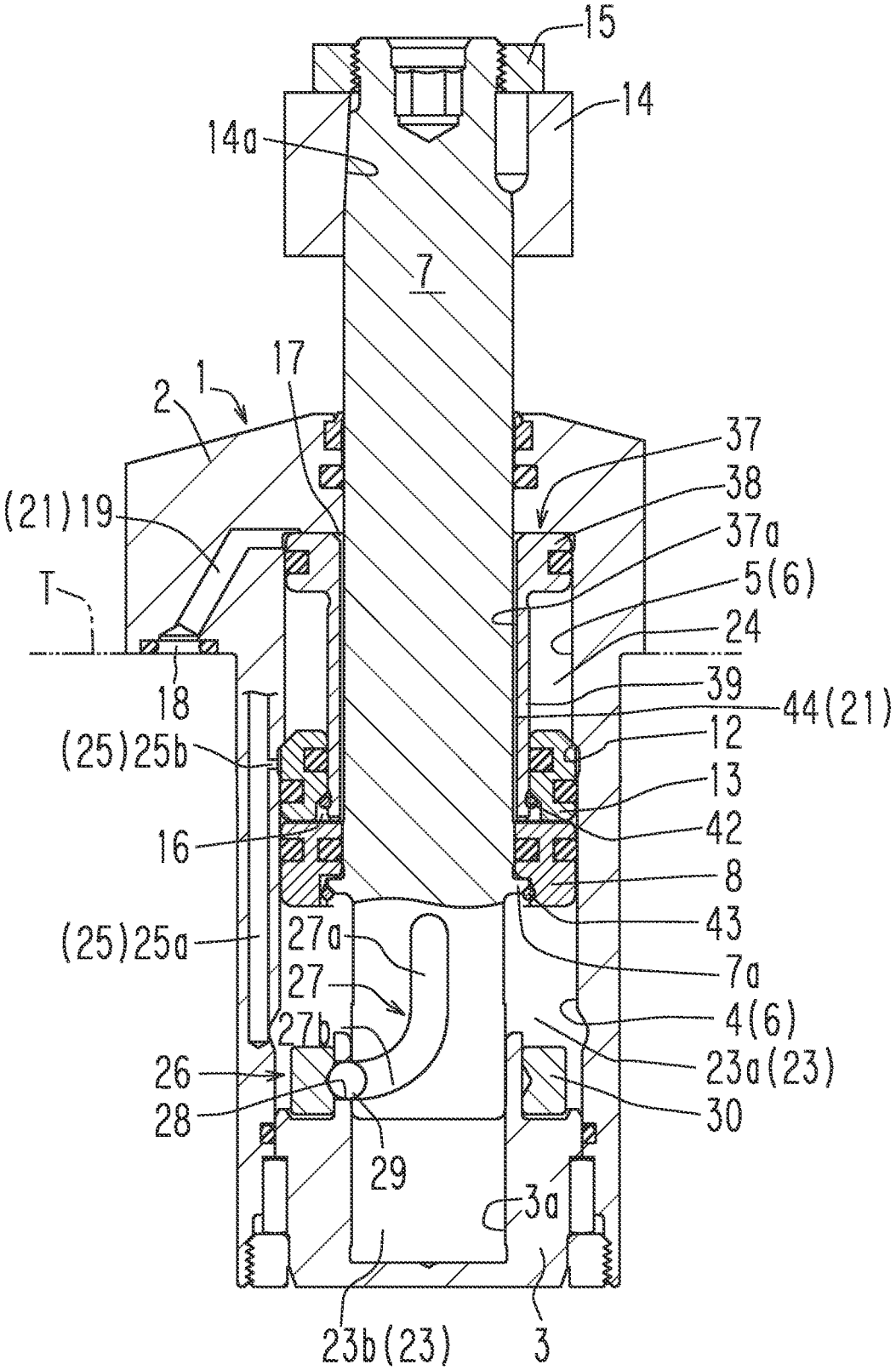
FIG. 8 shows a fourth embodiment of the present invention, and is an elevational view in section of a cylinder device in the release state.
Figure 9:
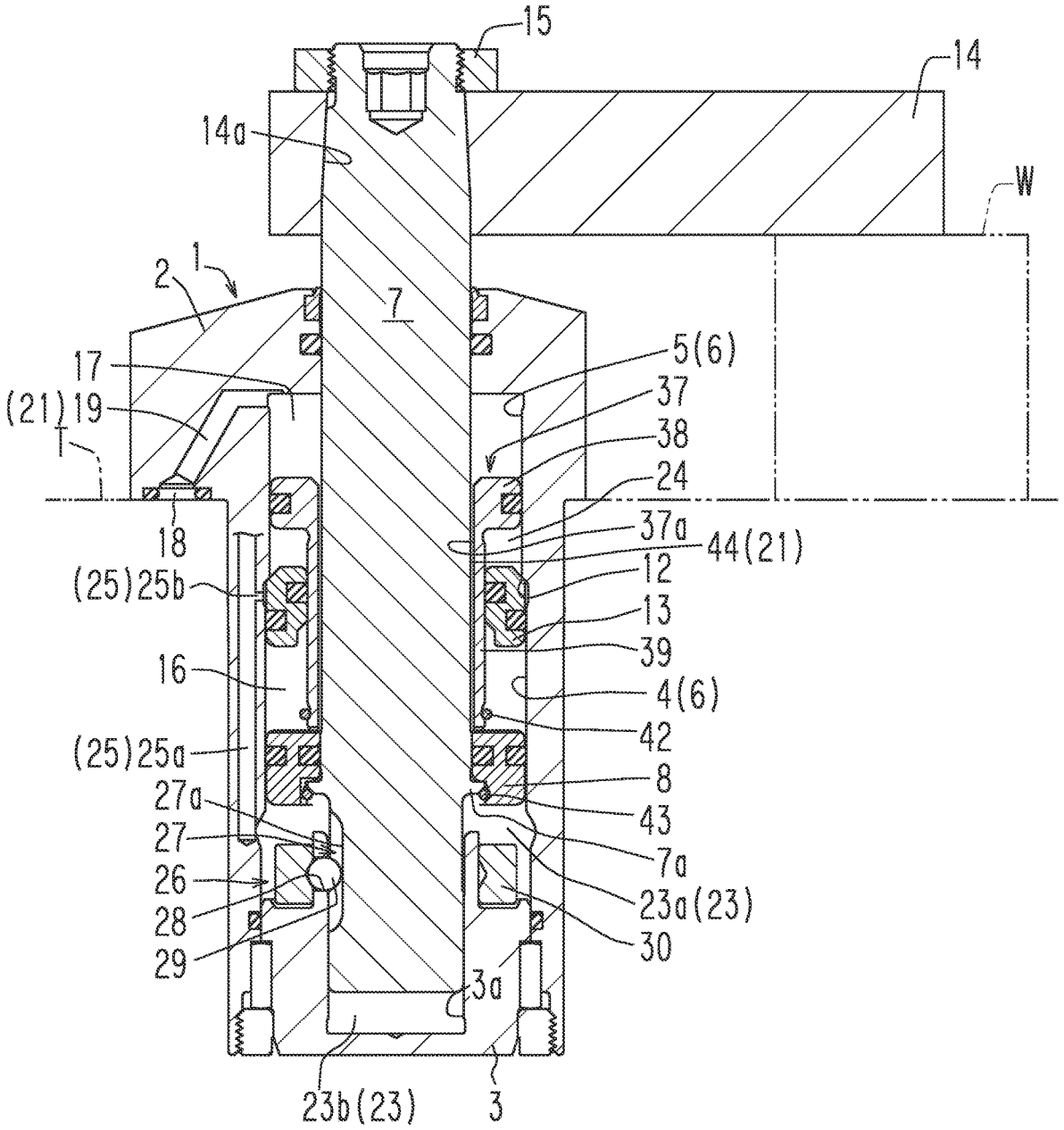
FIG. 9 is an elevational view in section of the cylinder device shown in FIG. 8, which is in the lock state.
Figure 10:
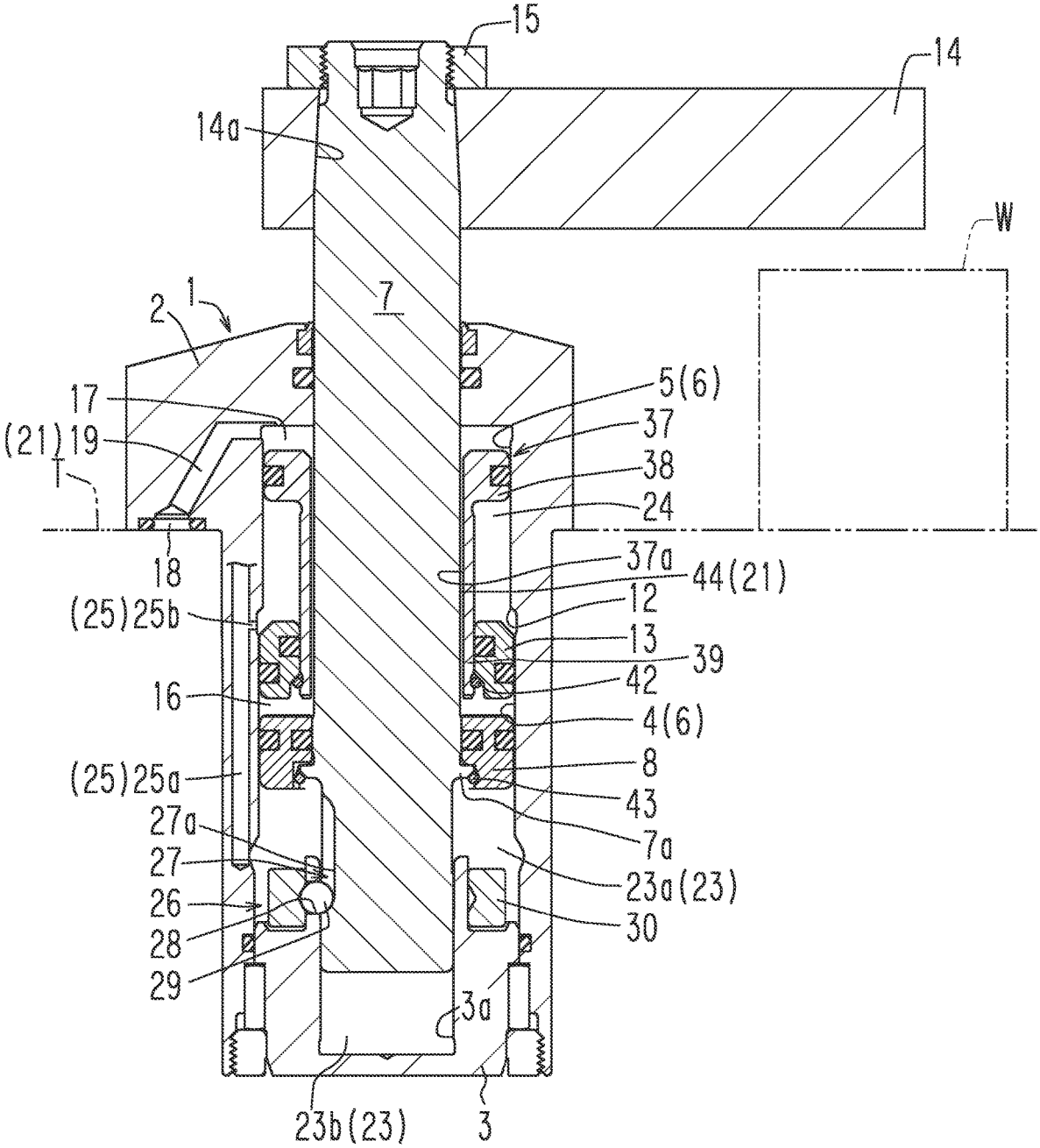
FIG. 10 is an elevational view in section of the cylinder device shown in FIG. 8, which is in the course of transition from the lock state to the release state.

FIG. 8 to FIG. 10 show a fourth embodiment of the present invention. The following describes differences between a cylinder device of the fourth embodiment and the cylinder device of the third embodiment shown in FIG. 6 and FIG. 7.

An insertion portion of the piston rod 7 of the cylinder device of the fourth embodiment, the insertion portion being inserted in the second piston 37, has a diameter slightly smaller than the diameter of the tubular hole 37*a* of the second piston 37. This creates an annular gap 44, functioning as a locking-purpose communication passage, between the tubular hole 37*a* of the second piston 37 and the outer peripheral surface of the piston rod 7. The locking-purpose passage 21 of the cylinder device of the fourth embodiment is constituted by the port-side passage 19 and by the gap 44.

The second piston 37 of the cylinder device of the fourth embodiment is configured to be engaged with the partition wall 13 via a retaining ring 42 attached to an outer periphery of an end portion of the guide portion 39. Meanwhile, the first piston 8 is fixed to the piston rod 7 with the flange portion 7*a* provided on the outer periphery of the lower portion of the piston rod 7, and with a retaining ring 43.

The operation of the cylinder device at the time of transition from the release state shown in FIG. 8 to the lock state shown in FIG. 9 is similar to that in the first embodiment. As pressurized oil is supplied from the lock port 18 to the second lock chamber 17 via the port-side passage 19, pressurized oil supplied to the second lock chamber 17 is also supplied to the first lock chamber 16 via the annular gap 44. As a result, the pressurized oil in the second lock chamber 17 causes the second piston 37 to push the piston rod 7 downward via the first piston 8, while the pressurized oil in the first lock chamber 16 causes the first piston 8 to push the piston rod 7 downward. This causes the piston rod 7 to descend.

The operation of the cylinder device at the time of transition from the lock state shown in FIG. 9 to the release state shown in FIG. 8 is also similar to that in the first embodiment. As pressurized oil is supplied to the first release chamber 23 and to the second release chamber 24 through the releasing-purpose passage 25, the partition wall 13 is temporarily lowered by the pressurized oil in the second release chamber 24, as shown in FIG. 10. Because of this, forces of the pressurized oil in the second release chamber 24 are canceled out with respect to the axial direction, and do not act to drive the piston rod 7. For this reason, the piston rod 7 is raised only by the force of the pressurized oil in the first release chamber 23.

The above-described embodiments are changeable as follows.

The first locking-purpose communication passage 32 and the second locking-purpose communication passage 33 of the cylinder device of the second embodiment each extends obliquely relative to the axial direction of the piston rod 7. Instead of this, the following arrangement is also possible, for example: a second locking-purpose communication passage is provided to extend laterally from the second lock chamber 17 toward the inside of the piston rod 7; and a first locking-purpose communication passage extending obliquely upward from the first lock chamber 16 is connected to the second locking-purpose communication passage. Furthermore, an inverted arrangement is also possible: a first locking-purpose communication passage is provided to extend laterally from the first lock chamber 16 toward the inside of the piston rod 7; and a second locking-purpose communication passage extending obliquely downward from the second lock chamber 17 is connected to the first locking-purpose communication passage.

That is, various arrangements are possible as long as: at least one of the first and second locking-purpose communication passages extends obliquely relative to the axial direction of the piston rod 7; and the first and second locking-purpose communication passages are connected to each other.

The cylinder device of the first embodiment may be arranged to include the releasing-purpose communication passage 35 provided in the piston rod 7 as in the second embodiment, to supply/discharge pressurized oil to/from the first release chamber 23 through the releasing-purpose communication passage 35 and via the second release chamber 24. Furthermore, the cylinder device of the second embodiment may be arranged to include the releasing-purpose passage 25 (25*a* and 25*b*) provided in the housing main body 2 as in the first embodiment, to supply/discharge pressurized oil directly to/from each of the first release chamber 23 and the second release chamber 24.

In the cylinder device of the third embodiment, the annular gap 44 in the fourth embodiment may be provided instead of the groove 41 extending in the axial direction. In the cylinder device of the fourth embodiment, the groove 41 extending in the axial direction in the third embodiment may be provided instead of the annular gap 44.

Pressure fluid for locking/releasing may be compressed gas such as compressed air and compressed nitrogen gas, instead of pressurized oil.

The cylinder device of the present invention is applicable not only to rotary clamps but also to clamping devices of other types, such as a clamping device with a non-rotary piston rod. Furthermore, the application is not limited to clamping devices. The present invention may be applied to reciprocating devices each configured to move an object backwards and forwards.

Embodiments and modifications of the present invention have been hereinabove described. It is a matter of course that other changes or alterations can be made on the present invention within the scope of envisagement of one skilled in the art.

REFERENCE SIGNS LIST

1: housing; 4: first cylinder hole; 5: second cylinder hole; 6: cylinder hole; 7: piston rod; 8: first piston; 10: second piston; 13: partition wall; 16: first lock chamber; 17: second lock chamber; 20: locking-purpose communication passage; 21: locking-purpose passage; 23: first release chamber; 24: second release chamber; 25: releasing-purpose passage; 26: piston rod rotating mechanism; 31: locking-purpose communication passage; 32: first locking-purpose communication passage; 33: second locking-purpose communication passage; 34: releasing-purpose passage; 35: releasing-purpose communication passage; 37: second piston; 37*a*: tubular hole; 38: second piston main body; 39: guide portion; 41: groove (locking-purpose communication passage); 44: gap (locking-purpose communication passage).

The invention claimed is:

1. A cylinder device comprising:

a housing;

a cylinder hole provided in the housing, the cylinder hole having a first cylinder hole and a second cylinder hole provided on a leading end side relative to the first cylinder hole;

a piston rod inserted in the cylinder hole so as to be movable in an axial direction;

a first piston inserted in the first cylinder hole so as to be movable in the axial direction, the piston rod being hermetically inserted in the first piston, the first piston being fixed to the piston rod;

a second piston inserted in the second cylinder hole so as to be movable in the axial direction, the piston rod being inserted in the second piston;

a partition wall dividing the cylinder hole into the first cylinder hole and the second cylinder hole, the partition wall being movable in the axial direction;

a first lock chamber provided between the first piston and the partition wall;

a second lock chamber provided on the leading end side relative to the second piston;

a first release chamber provided on a base end side relative to the first piston and to the piston rod;

a second release chamber provided between the partition wall and the second piston;

a locking-purpose passage through which pressure fluid is supplied to and discharged from the first lock chamber and the second lock chamber; and a releasing-purpose passage through which pressure fluid is supplied to and discharged from the first release chamber and the second release chamber;

wherein the piston rod is hermetically inserted in the second piston, and the second piston is fixed to the piston rod;

wherein the locking-purpose passage includes a locking-purpose communication passage which communicatively connects the first lock chamber and the second lock chamber to each other, and the locking-purpose communication passage is provided in the piston rod;

wherein the locking-purpose communication passage includes a first locking-purpose communication passage provided in the piston rod so as to extend from the first lock chamber, and a second locking-purpose communication passage provided in the piston rod so as to extend from the second lock chamber, and wherein at least one of the first locking-purpose communication passage and the second locking-purpose communication passage extends obliquely relative to the axial direction of the piston rod, and the first locking-purpose communication passage and the second locking-purpose communication passage are connected to each other.

2. The cylinder device according to claim 1, wherein:

the releasing-purpose passage includes a releasing-purpose communication passage which communicatively connects the first release chamber and the second release chamber to each other; and the releasing-purpose communication passage is provided in the piston rod.

3. The cylinder device according to claim 1, wherein a piston rod rotating mechanism is provided on the base end side relative to the first piston.

4. A cylinder device comprising:

a housing;

a cylinder hole provided in the housing, the cylinder hole having a first cylinder hole and a second cylinder hole provided on a leading end side relative to the first cylinder hole;

a piston rod inserted in the cylinder hole so as to be movable in an axial direction;

a first piston inserted in the first cylinder hole so as to be movable in the axial direction, the piston rod being hermetically inserted in the first piston, the first piston being fixed to the piston rod;

a second piston inserted in the second cylinder hole so as to be movable in the axial direction, the piston rod being inserted in the second piston;

a partition wall dividing the cylinder hole into the first cylinder hole and the second cylinder hole, the partition wall being movable in the axial direction;

a first lock chamber provided between the first piston and the partition wall;

a second lock chamber provided on the leading end side relative to the second piston;

a first release chamber provided on a base end side relative to the first piston and to the piston rod;

a second release chamber provided between the partition wall and the second piston;

a locking-purpose passage through which pressure fluid is supplied to and discharged from the first lock chamber and the second lock chamber; and a releasing-purpose passage through which pressure fluid is supplied to and discharged from the first release chamber and the second release chamber;

wherein the second piston includes:

an annular second piston main body; and a tubular guide portion extending in the axial direction from the second piston main body, the guide portion being hermetically inserted in the partition wall, wherein the locking-purpose passage includes a locking-purpose communication passage which communicatively connects the first lock chamber and the second lock chamber to each other, and wherein the locking-purpose communication passage is provided between a tubular hole of the second piston and an outer peripheral surface of the piston rod.

5. The cylinder device according to claim 4, wherein the locking-purpose communication passage is a groove provided on a surface of the piston rod and extending in the axial direction.

6. The cylinder device according to claim 4, wherein the locking-purpose communication passage is an annular gap between the tubular hole of the second piston and the outer peripheral surface of the piston rod.

7. The cylinder device according to claim 4, wherein the piston rod is inserted in the second piston, and the second piston is fixed to the piston rod.

8. The cylinder device according to claim 4, wherein the piston rod is inserted in the second piston, and the second piston is configured to be engaged with the partition wall.

9. The cylinder device according to claim 4, wherein a piston rod rotating mechanism is provided on the base end side relative to the first piston.

* * * * *